US010441129B2

(12) United States Patent
Pfeiffer et al.

(10) Patent No.: US 10,441,129 B2
(45) Date of Patent: Oct. 15, 2019

(54) CLEANING DEVICE WITH A CLEANING ROLLER THAT IS ROTATABLE ABOUT AN AXIS OF ROTATION

(71) Applicant: Vorwerk & Co. Interholding GmbH, Wuppertal (DE)

(72) Inventors: Matthias Pfeiffer, Stolberg (DE); Niklas Van Teeffelen, Aachen (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 39 days.

(21) Appl. No.: 15/580,748

(22) PCT Filed: Jun. 2, 2016

(86) PCT No.: PCT/EP2016/062550

§ 371 (c)(1),
(2) Date: Dec. 8, 2017

(87) PCT Pub. No.: WO2016/206941

PCT Pub. Date: Dec. 29, 2016

(65) Prior Publication Data

US 2018/0140156 A1 May 24, 2018

(30) Foreign Application Priority Data

Jun. 23, 2015 (DE) ..... 10 2015 110 022

(51) Int. Cl.
*B43M 11/02* (2006.01)
*A47L 11/40* (2006.01)
(Continued)

(52) U.S. Cl.
CPC ..... *A47L 11/4088* (2013.01); *A47L 11/085* (2013.01); *A47L 11/125* (2013.01);
(Continued)

(58) Field of Classification Search
CPC ..... A47L 11/282; A47L 11/4041; A47L 11/4088; A47L 11/4083; A47L 11/185; A47L 11/125; A47L 11/085
(Continued)

(56) References Cited

U.S. PATENT DOCUMENTS 8,220,098 B2 * 7/2012 Wilkins ..... A46B 11/066 137/268
8,555,446 B2 * 10/2013 Moes ..... A46B 11/002 15/179

(Continued)

FOREIGN PATENT DOCUMENTS

DE 20 2007 017 026 U1 4/2009
DE 20 2009 013 813 U1 3/2010
GB 903 786 A 8/1962

OTHER PUBLICATIONS

International Search Report of PCT/EP2016/064054, dated Oct. 6, 2016.

(Continued)

*Primary Examiner* — Jennifer C Chiang
(74) *Attorney, Agent, or Firm* — Collard & Roe, P.C.

(57) ABSTRACT

A cleaning device has a cleaning roller that is rotatable about an axis of rotation and serves for treating a surface to be cleaned. The cleaning roller is in the form of a hollow body with an internal liquid chamber, and at least one hollow body opening for releasing liquid from the liquid chamber. In order to develop a cleaning device, in which liquid is only released from the liquid chamber to the surface of the hollow body under certain conditions, a mechanically actuated valve element is assigned to the hollow body opening, wherein the valve element can be displaced into a closing position, in which the hollow body opening is closed, and/or into an opening position, in which the hollow body opening is released, depending on the magnitude of a centrifugal force that acts upon the valve element as a result of a rotation of the cleaning roller.

10 Claims, 3 Drawing Sheets

(51) Int. Cl.

| | |
|---|---|
| ***A47L 11/12*** | (2006.01) |
| ***A47L 11/08*** | (2006.01) |
| ***A47L 11/18*** | (2006.01) |
| ***A47L 11/282*** | (2006.01) |

(52) U.S. Cl.
CPC ..... *A47L 11/185* (2013.01); *A47L 11/282* (2013.01); *A47L 11/4041* (2013.01); *A47L 11/4083* (2013.01)

(58) Field of Classification Search
USPC ..... 401/219
See application file for complete search history.

(56) References Cited

U.S. PATENT DOCUMENTS

| | | | | |
|---|---|---|---|---|
| 2007/0221248 | A1* | 9/2007 | Boatman | A46B 11/063 134/6 |
| 2011/0219555 | A1 | 9/2011 | Field et al. | |
| 2015/0327743 | A1* | 11/2015 | Van Der Kooi | A47L 11/4041 15/322 |
| 2018/0168418 | A1* | 6/2018 | Pfeiffer | A47L 11/4041 |
| 2018/0242810 | A1* | 8/2018 | Jang | A47L 11/185 |
| 2019/0022269 | A1* | 1/2019 | Hackert | A47L 11/24 |

OTHER PUBLICATIONS

International Search Report of PCT/EP2016/062550, dated Jul. 22, 2016.

* cited by examiner

CLEANING DEVICE WITH A CLEANING ROLLER THAT IS ROTATABLE ABOUT AN AXIS OF ROTATION

CROSS REFERENCE TO RELATED APPLICATIONS

This application is the National Stage of PCT/EP2016/062550 filed on Jun. 2, 2016, which claims priority under 35 U.S.C. § 119 of German Application No. 10 2015 110 022.3 filed on Jun. 23, 2015, the disclosures of which are incorporated by reference. The international application under PCT article 21(2) was not published in English.

TECHNICAL FIELD

The invention relates to a cleaning device, particularly a floor cleaning device, with a cleaning roller that is rotatable about an axis of rotation and serves for treating a surface to be cleaned, wherein the cleaning roller is at least partially realized in the form of a hollow body with an internal liquid chamber, and wherein the hollow body features at least one hollow body opening for releasing liquid from the liquid chamber.

PRIOR ART

Cleaning devices of the above-described type are known from the prior art. For example, publication DE 20 2007 017 026 U1 discloses a floor cleaning device with a cleaning roller that is realized in the form of a wiping roller and supplied with cleaning liquid from its interior. To this end, the cleaning roller features a liquid-permeable hollow body. This hollow body is provided with openings, for example in the form of holes, slots, bores and the like, in order to moisten a cleaning cloth applied to the outside of the cleaning roller. The cleaning cloth and/or a sponge body arranged, if applicable, between the hollow body and the cleaning cloth is realized in an absorbent fashion such that liquid is permanently drawn from the hollow body through the openings. The liquid is respectively transferred from the cleaning cloth or the sponge body to the surface to be cleaned due to the contact pressure during a displacement of the cleaning device over the surface to be cleaned.

In this case, it is disadvantageous that liquid from the liquid chamber of the cleaning roller is permanently released to the surface of the hollow body, i.e. the cleaning cloth and/or the sponge body. Consequently, liquid is also released, for example, when the cleaning roller is not used for a cleaning process, but rather merely transported, for example.

SUMMARY OF THE INVENTION

The invention is therefore based on the objective of developing a cleaning device, in which liquid is only released from the liquid chamber to the surface of the hollow body under certain conditions such that an undesirable discharge or dripping cannot occur.

In order to attain this objective, the invention proposes to assign a mechanically actuated valve element to the hollow body opening, wherein said valve element can be displaced into a closing position, in which the hollow body opening is closed, and/or into an opening position, in which the hollow body opening is released, depending on the magnitude of a centrifugal force that acts upon the valve element as a result of a rotation of the cleaning roller.

According to the invention, liquid is either released or not released from the liquid chamber to the surface of the hollow body depending on the centrifugal force acting upon the valve element. The term mechanically actuated valve element therefore refers to an automatic force-actuated valve and not a valve that is manually actuated by a user. The invention is based on the realization that a speed-dependent centrifugal force acts upon the valve element during a rotation of the cleaning roller and presses the liquid located in the hollow body radially outward against the valve element. As soon as the centrifugal force exceeds the closing force of the valve element, the valve element opens in order to release liquid from the liquid chamber. In this case, the centrifugal force acting upon the valve element is dependent on the mass of the liquid, the mass of the valve element, the respective distance of the liquid and the valve element from the axis of rotation x and the rotational speed of the cleaning roller. The hollow body opening is released by the valve element once a minimum centrifugal force, which is defined by the current parameters of the cleaning roller and the liquid, is exceeded. In this case, the valve element is displaced from the closing position into the opening position.

It is proposed that the valve element is designed for allowing a release of liquid from the liquid chamber once the cleaning roller has reached a minimum rotational speed. At otherwise constant parameters, the displacement of the valve element from the closing position into the opening position and vice versa is only dependent on the rotational speed of the cleaning roller about the axis of rotation. In this case, the minimum rotational speed is defined such that the valve element is displaced into the opening position and therefore allows the release of liquid from the liquid chamber once this minimum rotational speed has been exceeded. In this context, it is recommended to maintain a constant quantity of liquid within the liquid chamber, i.e. to correspondingly replenish the liquid discharged through the hollow body openings. The liquid in the liquid chamber cannot reach the surface of the hollow body as long as the defined minimum rotational speed is not reached, i.e. when the cleaning roller rotates with a slow rotational speed. Consequently, an adjustment of the rotational speed of the cleaning roller makes it possible to purposefully control when liquid is released from the hollow body and when no liquid is released from the hollow body. In this way, the release of liquid can be effectively prevented while the cleaning device is merely transported, in which case the cleaning roller typically does not rotate. During a cleaning process that requires the use of cleaning liquid, however, the cleaning roller is rotated with a rotational speed that exceeds the minimum rotational speed such that the centrifugal force displaces the valve element into the opening position and liquid can be transferred to the surface to be cleaned. If the liquid in the liquid chamber is not permanently replenished, the definition of a suitable minimum rotational speed may (conservatively) also be based on an empty liquid chamber.

It is proposed that a return element, particularly a spring, is assigned to the valve element and/or that the valve element is realized in the form of a return element, wherein the restoring force of the return element acts opposite to the centrifugal force in the direction of the closing position. The restoring force of the return element counteracts the centrifugal force exerted upon the valve element. In this case, the return element may be realized separately of the valve element, for example, in the form of a separate pressure spring, tension spring, torsion spring or the like. Alternatively, the valve element itself may be realized in the form of the return element or the return element may form an integral component of the valve element. For example, the valve element may consist of an elastic material that can be at least partially displaced due to the centrifugal force. The valve element may feature, for example, an integral hinge or be realized elastically in the edge region of the hollow body opening such that a displacement can be realized due to the centrifugal force acting thereupon. In this case, the return element has to be respectively designed in such a way that its restoring force is at a defined rotational speed of the cleaning roller lower than the exerted centrifugal force and the valve element opens once the minimum rotational speed has been exceeded. An empty liquid chamber (without liquid) can be advantageously used for the calculation.

It would be conceivable that the valve element features at least one closing element that is pivotably arranged on the hollow body. This pivotable closing element may consist, for example, of a pivotable valve flap that is arranged on the edge region of the hollow body, which defines the hollow body opening. The valve element may either comprise only one pivotably arranged closing element, i.e. only one valve flap, or multiple closing elements. In this case, the closing element or the closing elements may be offset radially inward or radially outward relative to the surface of the hollow body such that they respectively end flush with the outer or inner surface of the hollow body. The pivotable closing element may either be realized in the form of a separate closing element that is fixed on the hollow body or integrally with the hollow body, for example in the form of an integral hinge, an elastic edge region of the hollow body or the like.

It would furthermore be conceivable that the valve element features a closing element, which is arranged on the hollow body in a linearly movable fashion, in particular slidably. In the closing position of the valve element, the closing element is arranged in front of the hollow body opening and can be spaced apart from the hollow body opening by being moved perpendicular to the plane of the hollow body opening. It is particularly proposed that the closing element is arranged on a free end region of a return element, particularly a spring, the restoring force of which acts perpendicular to the plane of the hollow body opening. Once a certain magnitude of the centrifugal force has been exceeded, the closing element is therefore moved away from the hollow body opening against the restoring force of the return element such that a flow path for liquid to be released from the hollow body is formed between the hollow body opening and the closing element.

It is furthermore proposed that the valve element is formed by an elastic edge region of the hollow body, which defines the hollow body opening. According to this embodiment, the hollow body comprises an elastic material at least in the edge region of the hollow body opening such that the edge region is displaced radially outward (referred to the hollow body) due to the centrifugal force exerted thereupon and the hollow body opening is enlarged. With respect to its closing position, the elastic edge region is advantageously designed such that no liquid can escape through the hollow body opening. This can be achieved with portions of the edge regions that overlap one another in the closing position. In the opening position, the edge regions are spaced apart from one another and the hollow body opening is released.

The hollow body may furthermore be formed by an at least partially elastic diaphragm, wherein at least one hollow body opening is contracted in the closing position and expanded in the opening position. Consequently, the hollow body may be formed by a diaphragm containing, for example, pinhole-like hollow body openings that open to a greater or lesser extent depending on the magnitude of the exerted centrifugal force and thereby release a flow path for the liquid from the hollow body. The hollow body openings are thereby contracted into a point in the closing position and expanded in the opening position. In this context, it is recommended to use a diaphragm material with a modulus of elasticity that makes it possible to quickly open and close the hollow body openings in dependence on a change in the magnitude of the centrifugal force. Rubber-like materials are particularly suitable for this purpose.

It would alternatively be conceivable that an at least partially elastic diaphragm containing at least one diaphragm opening is arranged on the hollow body. In this case, the hollow body is preferably made of a hard plastic and coated with an elastic or at least partially elastic diaphragm. The diaphragm contains diaphragm openings, through which liquid to be released from the hollow body can flow outward.

It is particularly recommended that the diaphragm opening of the diaphragm and the hollow body opening of the hollow body are arranged on a common straight line referred to a radial direction of the cleaning roller. In this way, the openings of the diaphragm and the hollow body lie on top of one another such that liquid being released from the hollow body can reach the outwardly directed surface of the diaphragm directly through the corresponding diaphragm opening. Alternatively, it would basically also be conceivable that the diaphragm opening and the hollow body opening do not lie exactly on top of one another, but the diaphragm and the hollow body rather contain, for example, a plurality of openings that are irregularly arranged over their circumference similar to two perforated walls lying on top of one another.

It is proposed that the diaphragm is arranged on the hollow body in a stationary fashion. The diaphragm may particularly be fastened on the radially outer side of the hollow body. Different fastening methods such as, for example, coating, injection-molding, bonding or the like may be considered for this purpose. The stationary arrangement of the diaphragm on the hollow body makes it possible to form constant flow paths for the liquid, which also remain during a rotation of the cleaning roller.

The inventive cleaning device is not only limited to wet-cleaning devices, but may likewise consist of a dry-cleaning device, which is only operated with a rotational speed in excess of the minimum rotational speed in order to clean the cleaning roller. The minimum rotational speed is not exceeded while the cleaning roller rotates during a normal surface cleaning process such that no liquid can escape from the hollow body. In this way, the cleaning roller can be used for carrying out a dry-cleaning process at a first, slow rotational speed without inadvertently releasing liquid from the hollow body. No liquid is released from the liquid chamber until the minimum rotational speed of the cleaning wall has been reached or exceeded.

It is proposed that the defined minimum rotational speed of the cleaning roller lies between at least 150 rpm and no more than 3000 rpm. The cited minimum rotational speed of 150 rpm can be clearly distinguished from an accidental rotation of the cleaning roller during a transport of the cleaning device. This minimum rotational speed likewise exceeds the rotational speed of the cleaning roller during a mere displacement of the cleaning device over the surface to be cleaned. The cited rotational speed range of 150 rpm to 3000 rpm particularly corresponds to normal rotational speeds of the cleaning roller during a surface cleaning process or a self-cleaning process of the cleaning roller for removing adhering dirt. In this case, the required minimum rotational speed for releasing liquid from the hollow body is defined by the aforementioned parameters that affect the centrifugal force.

It is ultimately proposed that the hollow body is covered with a sponge body. It would additionally or alternatively be conceivable that the hollow body and/or the sponge body are covered with a cleaning cloth, particularly a microfiber cloth. The surface of the cleaning roller is thereby formed by a sponge body and/or a cleaning cloth. The cleaning cloth may consist, for example, of a textile cleaning cloth, in which the dirt removed from the surface to be cleaned is retained. In this context, it proved particularly advantageous to realize the cleaning cloth in the form of a microfiber cloth. This is particularly effective with respect to the dirt removal from the surface to be cleaned. The cleaning cloth or the sponge body is advantageously absorbent such that a certain quantity of liquid can be stored therein. A sponge body may be provided instead of the cleaning cloth or alternatively between the hollow body and the cleaning cloth. This sponge body particularly serves for intermediately storing the liquid. It absorbs the liquid being released through the hollow body openings of the hollow body and respectively transfers this liquid to the cleaning cloth and the surface to be cleaned.

BRIEF DESCRIPTION OF THE DRAWINGS

The invention is described in greater detail below with reference to exemplary embodiments. In the drawings.

DESCRIPTION OF THE EMBODIMENTS

Figure 1:
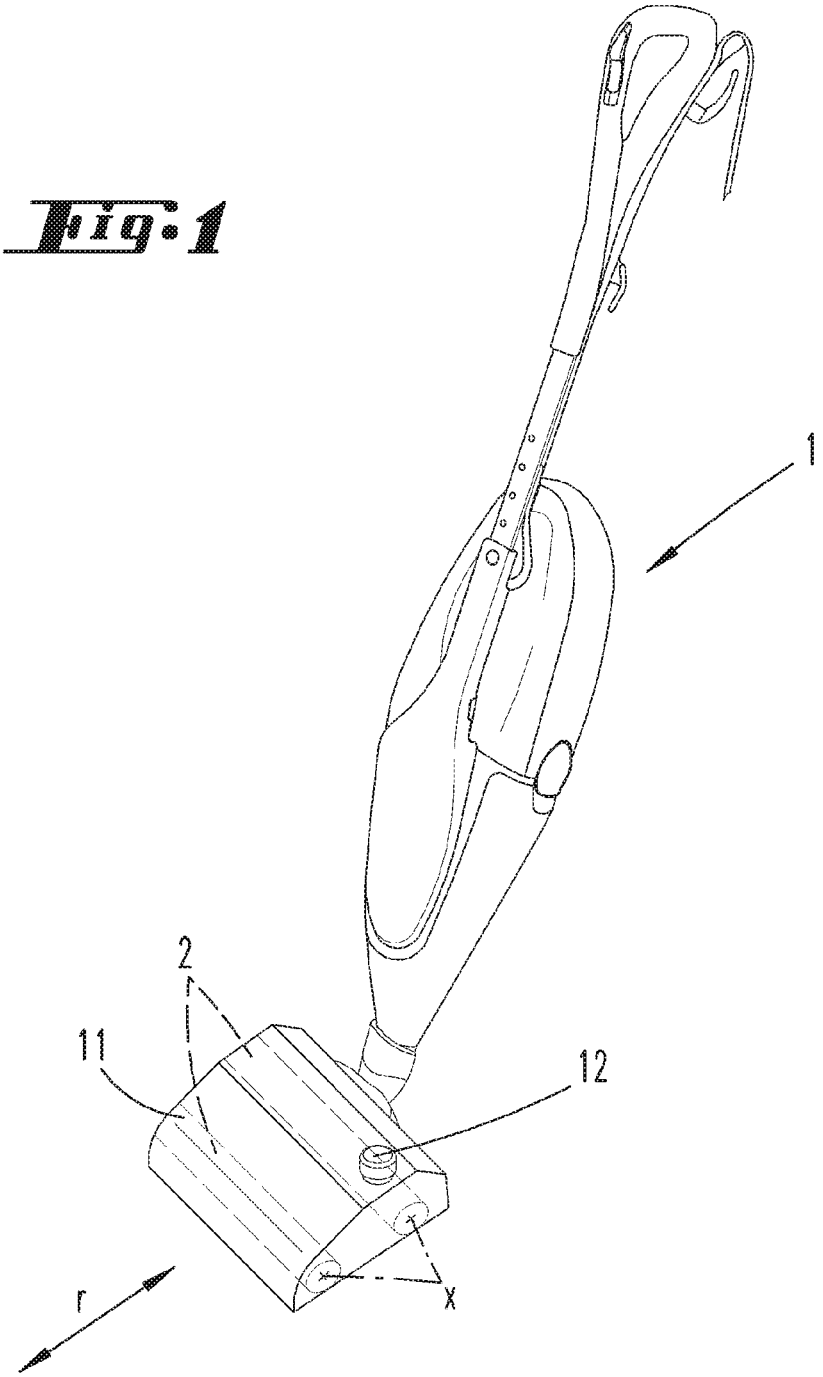
FIG. 1 shows an inventive cleaning device.

A cleaning device 1 in the form of a wet-cleaning device for wet-cleaning a surface to be cleaned is initially described with reference to FIG. 1. The cleaning device 1 features an attachment 11 that is in contact with the surface to be cleaned during a cleaning process. In the example shown, the attachment 11 features two cleaning rollers 2 that can be acted upon with liquid from inside. To this end, the attachment 11 features a (not-shown) tank that can be filled with liquid through a filler opening 12. The liquid is continuously conveyed from the tank to the cleaning rollers 2 through liquid lines. The cleaning device 1 is supported on the surface to be cleaned by means of the two cleaning rollers 2. The cleaning rollers 2 extends transverse to a normal moving direction r of the cleaning device 1, which results from a normal working motion of a user of the cleaning device 1 that generally extends alternately forward and backward, if applicable, while diverting into a nearest parallel cleaning path. The cleaning rollers 2 approximately extend over the entire width of the cleaning device 1 transverse to the moving direction r. According to the arrangement shown, one cleaning roller 2 is respectively arranged on the front and on the rear of the attachment 11 referred to a motion of the cleaning device 1 in the moving direction r. The cleaning rollers 2 can be driven, i.e. rotated about an axis of rotation x, by means of an electric motor. The cleaning rollers 2 are not actively driven during a normal motion of the cleaning device 1 without treatment of a surface to be cleaned. In fact, only a passive rotation of the cleaning rollers 2 takes place in this case due to the frictional engagement with the surface to be cleaned. However, the cleaning rollers 2 are actively rotated by means of the motor during a cleaning process of the surface by means of the cleaning rollers 2 and/or during a self-cleaning process of the cleaning rollers 2. In this case, a wiping edge is formed along the contact line between the cleaning roller 2 and the surface to be cleaned. This wiping edge makes it possible to clean the surface with a motion relative thereto such that dirt is removed. The cleaning rollers 2 are supplied with a liquid for wet-cleaning processes. This liquid advantageously consists of water and, if applicable, an additional cleaning agent containing surfactants. This liquid is initially stored in the tank of the attachment 11. The cleaning rollers 2 are subsequently supplied with the liquid via the liquid lines. The liquid lines are connected to the axial face regions of the cleaning rollers 2. A free end region of the liquid line therefore extends parallel to an axis of rotation x of a cleaning roller 2.

Figure 2:
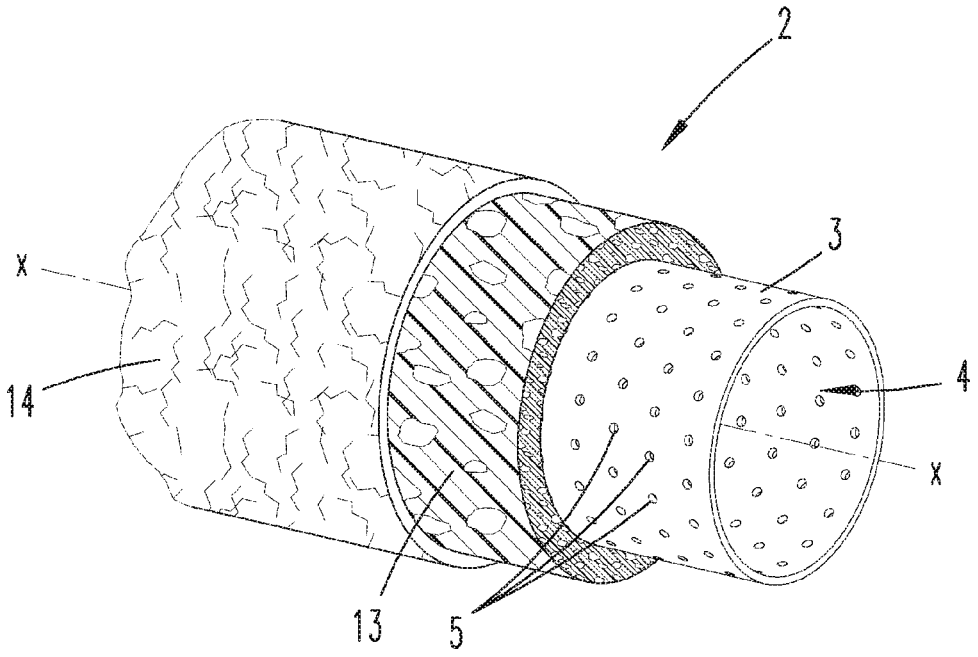
FIG. 2 shows an inventive cleaning roller.

FIG. 2 shows a detail of the cleaning roller 2. In this case, the cleaning roller 2 is essentially illustrated in the form of an exploded view with respect to its different covers. The cleaning roller 2 is basically designed in the form of a cylindrical hollow body 3 that is closed on its face sides, wherein the closure on the face side is not illustrated in this figure in order to provide a better overview. The hollow body 3 consists of a hard plastic and contains a plurality of circumferentially extending, liquid-permeable hollow body openings 5. A likewise cylindrical liquid chamber 4 for accommodating liquid is formed within the hollow body 3. Under certain conditions, liquid can be released outward from the liquid chamber 4 through the hollow body openings 5. The hollow body 3 is surrounded by a sponge body 13, which is arranged on the hollow body in a rotationally rigid fashion. The sponge body 13 has an open-pored design and is capable of intermediately storing liquid. Furthermore, the sponge body 13 is covered with a cleaning cloth 14, which is realized in the form of a microfiber cloth in this case. The cleaning cloth 14, the sponge body 13 and the hollow body 13 are connected to one another in a rotationally rigid fashion and jointly rotatable about the axis of rotation x.

The liquid chamber 4 of the hollow body 3 serves for storing the liquid. This storage chamber is replenished by the above-describes tank via the liquid lines. As soon as the sponge body 13 and/or the cleaning cloth 14 are acted upon with liquid, they transfer the liquid to the surface to be cleaned under the pressure generated by a displacement of the cleaning device 1 on the surface to be cleaned. During this process, liquid is discharged in the region of the wiping edge. In this case, the liquid is squeezed out of the sponge body 13 and/or the cleaning cloth 14 and applied to the surface to be cleaned by means of the cleaning cloth 14. Dirt is removed from the surface to be cleaned and transferred to the cleaning cloth 14 during the further rotation of the cleaning roller 2 in the moving direction r of the cleaning device 1.

FIGS. 3-6 respectively show schematic sections through a hollow body 3 of a cleaning roller 2. The hollow body 3 has a surface that contains a plurality of hollow body openings 5, wherein only one hollow body opening 5 is respectively illustrated (in FIGS. 3-5) in order to simplify the drawing. The hollow body openings 5 may be regularly or irregularly distributed over the hollow body 3. The hollow body 3 encloses the liquid chamber 4 that serves for accommodating a liquid. The liquid can be released from the liquid chamber 4 to the surface of the hollow body 3 through the hollow body openings 4. As described above, the hollow body 3 may, if applicable, also be surrounded by a sponge body 13 and/or a cleaning cloth (which are not illustrated in FIGS. 3-6). A ring of liquid, the centrifugal force of which acts upon the inner wall of the hollow body 3, is formed in the liquid chamber 4 of the hollow body 3 due to the rotation of the cleaning roller 2. Starting from the axis of rotation x, the centrifugal force acts radially in the direction of the inner wall of the hollow body 3, as well as the hollow body openings 5 arranged therein.

According to the figures, a valve element 6 is assigned to each hollow body opening 5 and closes or releases the respective hollow body opening 5 in dependence on the magnitude of the centrifugal force. The figures show different embodiments of the valve element 6. However, the valve element is in all embodiments designed such that it can be displaced into a closing position, in which the hollow body opening 5 is closed, and/or into an opening position, in which the hollow body opening 5 is released, depending on the current magnitude of the centrifugal force acting upon the valve element 6 as a result of the rotation of the cleaning roller 2. To this end, the respective valve elements 6 feature one or more closing elements 7, which are prestressed in the direction of the closing position and therefore opposite to the centrifugal force such that the force attempting to close the hollow body opening opposes the centrifugal force. The hollow body opening 5 is either opened or closed depending on the magnitude of the closing force and the magnitude of the centrifugal force such that liquid is either released from the liquid chamber or not. A centrifugal force of greater or lesser magnitude acts upon the valve element 6 in dependence on the current rotational speed of the cleaning roller 2. In this case, liquid is released from the liquid chamber 4 once a defined minimum rotational speed has been reached. This minimum rotational speed depends on parameters of the hollow body opening 5 and the valve element 6, as well as on the quantity of liquid pressing against the valve element 6 during the rotation of the cleaning roller 2.

Figure 3:
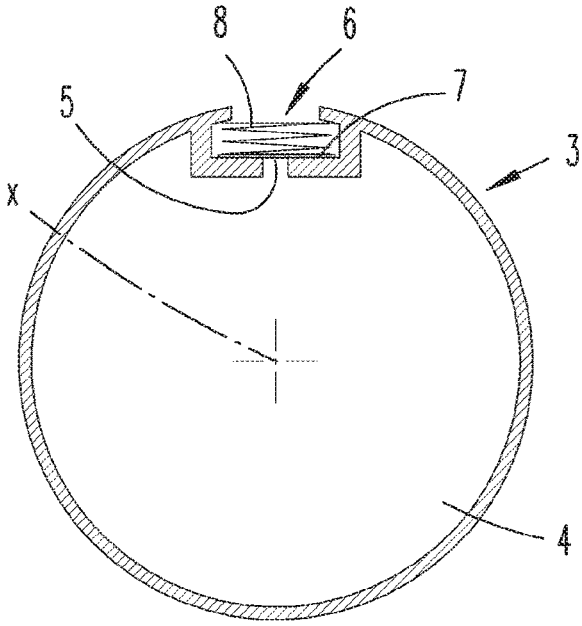
FIG. 3 shows a hollow body of a cleaning roller according to a first embodiment.

FIG. 3 shows a first embodiment of a hollow body 3. In this case, the hollow body 3 features a valve element 6 that is assigned to a hollow body opening 5. The hollow body opening 5 is offset radially inward in the direction of the axis of rotation x starting from the outer surface of the hollow body 3, wherein a chamber-like valve region, which is fluidically separated from the liquid chamber 4, is formed between the hollow body opening 5 and the surface of the hollow body 3. A closing element 7 of the valve element 6 is arranged in the chamber-like valve region and can be displaced into a closing position, in which the hollow body opening 5 is closed, and into an opening position, in which the hollow body opening 5 is released. For this purpose, a return element 8 is formed within the valve region between the surface of the hollow body 3 and the lower body opening 5, wherein said return element carries the closing element 7 on an end region adjacent to the hollow body opening 5. In this case, the return element 8 is realized in the form of a coil spring, on one face of which the plate-shaped closing element 7 is arranged. The return element 8 exerts its restoring force upon the closing element 7 and presses this closing element against the edge region of the hollow body 3, which defines the hollow body opening 5. The hollow body opening 5 is thereby closed in a fluid-tight fashion such that no liquid can escape from the liquid chamber 4. The closing element 7 is advantageously made of a sealing material such as a rubber-like material. It would alternatively also be conceivable, for example, that the edge region of the hollow body 3, which defines the hollow body opening 5, features a sealing ring or the like.

Figure 4:
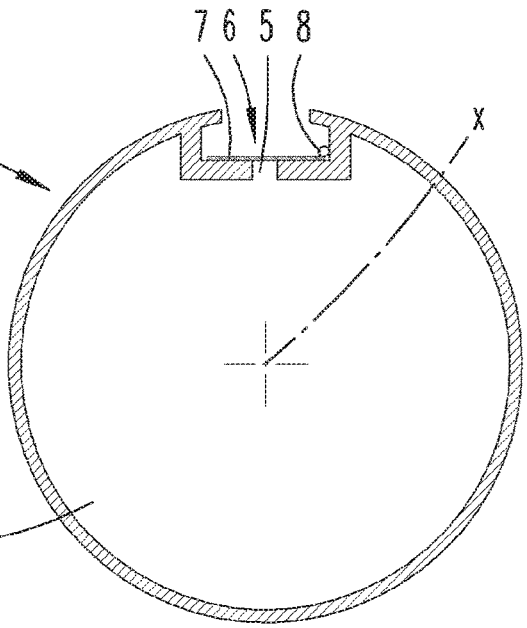
FIG. 4 shows a hollow body of a cleaning roller according to a second embodiment.

During a standstill of the cleaning roller 2 or during a rotation of the cleaning roller 2 with a rotational speed, which lies below the minimum rotational speed for releasing liquid from the liquid chamber 4, the closing element 7 is pressed against the edge region of the hollow body opening 5 in a sealing fashion due to the restoring force of the return element 8. In this way, no liquid can escape from the liquid chamber 4. When the rotational speed of the cleaning roller 2 increases, for example, in order to clean a surface to be cleaned or to self-clean the cleaning roller 2, the centrifugal force acting upon the side of the valve element 6, which points in the direction of the axis of rotation x, increases accordingly. In this case, the centrifugal force comprises a force component based on the liquid that is contained in the liquid chamber 4 and acts against the closing element 7, as well as a force component based on the mass of the valve element 6 itself, particularly the closing element 7 and the return element 8. In this case, the centrifugal force counteracts the restoring force of the return element 7. As the rotational speed of the cleaning roller 2 increases, the magnitude of the centrifugal force increases accordingly until the centrifugal force ultimately exceeds the restoring force. Once the minimum rotational speed of the cleaning roller 2 has been reached, the closing element moves away from the hollow body opening 5 such that liquid from the liquid chamber 4 can enter the chamber-like valve region of the valve element 6 and ultimately reach the surface of the hollow body 3. If applicable, the liquid can be absorbed on the surface of the hollow body 3 by a sponge body 13 and/or a cleaning cloth 14 in order to optimally wet the surface to be cleaned with liquid. The valve element 6 is therefore arranged on the hollow body 3 in a linearly movable fashion FIG. 4 shows a second embodiment of the invention, in which the valve element 6 features a closing element 7, in this case a cover flap, which is pivotably arranged on the hollow body 3. The flap-like closing element 7 is arranged within the chamber-like valve region of the hollow body 3 together with a return element 6, which is realized in the form of a torsion spring in this case. The return element 8 is assigned to the axis of rotation of the closing element 7, wherein the restoring force attempts to pivot the closing element 7 into the closing position, in which the hollow body opening 5 is closed. In the opening position, the closing element 7 contacts a limit stop formed on the chamber-like valve region of the hollow body 3 such that the pivoting angle in the opening position is limited. During the rotation of the cleaning roller 2, the restoring force of the return element 8 counteracts the centrifugal force such that the valve element 6 is not pivoted into the opening position in order to thereby release liquid from the liquid chamber 4 until a minimum rotational speed of the cleaning roller 2 has been reached.

Figure 5:
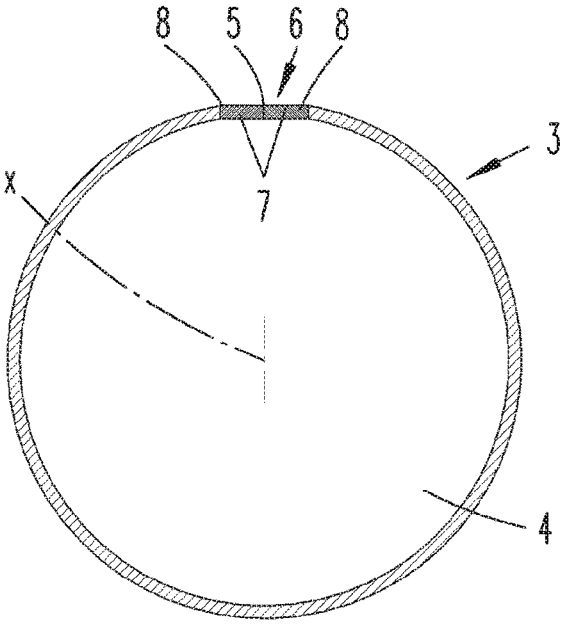
FIG. 5 shows a hollow body of a cleaning roller according to a third embodiment.

FIG. 5 shows a third embodiment of the invention, in which the valve element 6 is formed by an elastic edge region of the hollow body 3, which defines the hollow body opening 5. In this case, the valve element 6 (illustrated in dark gray) consists, for example, of a rubber material that is respectively displaced in the direction of the closing position or the opening position in dependence on the inherent restoring force of the material and the magnitude of the centrifugal force. The centrifugal force, which radially acts upon the respective closing element 7 from inside, causes the closing elements 7, namely the edge regions of the hollow body 3, to elastically deform radially outward such that the hollow body opening 5 is released in order to discharge liquid from the liquid chamber 4. As soon as the centrifugal force drops again due to a reduction of the rotational speed of the cleaning roller 2 below a defined minimum rotational speed, the restoring force of the closing element 7 predominates such that the valve element 6 is once again displaced into the closing position. The closing elements 7 may be realized integrally with the remaining sections of the hollow body 3, wherein different materials may, among other things, also be connected to one another by means of injection molding, welding or the like. It would furthermore be possible that the closing elements 7 are connected to the remaining sections of the hollow body 3 by means of an integral hinge and an axis of rotation for the pivoting motion of the closing elements 7 is formed between the closing elements 7 and the hollow body 3. This axis of rotation is advantageously prestressed in the direction of the closing position either due to the respective material or by means of a separate return element 8. Although the closing elements 7 have the same thickness as the wall of the hollow body 3 in the drawings, it would also be conceivable that the closing elements 7 have a smaller thickness and are arranged on the hollow body 3 such that they are offset inward or outward. Furthermore, it is naturally also possible to use a different number of closing element 7 such as, for example, only one closing element 7, two closing elements 7 or multiple closing elements 7. The hollow body opening 5 can be selectively realized round, oval, angular, etc.

Figure 6:
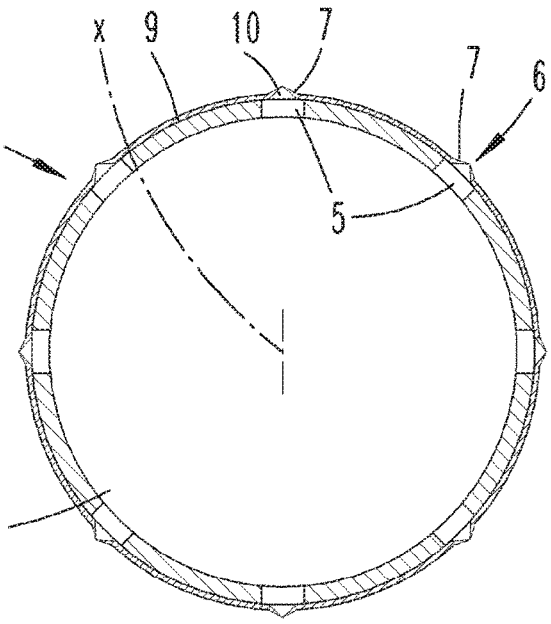
FIG. 6 shows a hollow body of a cleaning roller according to a fourth embodiment.

FIG. 6 ultimately shows a fourth embodiment of the invention, in which the hollow body 3 is surrounded by an elastic diaphragm 9. The diaphragm 9 is arranged on the hollow body 3 in a stationary fashion, i.e. rotationally rigid, wherein the diaphragm 9 is fastened on the side of the hollow body 3 that faces away from the axis of rotation x. The diaphragm 9 contains a plurality of diaphragm openings 10, wherein a diaphragm opening 10 is assigned to each hollow body opening 5 of the hollow body 3 such that the openings 5, 10 radially lie on a common straight line starting from the axis of rotation x. The elastic material of the diaphragm 9 is realized in an overlapping fashion in the region of the diaphragm openings 10 such that the pinhole-like diaphragm openings 10 are closed in the closing position, wherein the material is in the opening position pressed outward due to the centrifugal force, which radially acts upon the material from inside, such that the diaphragm openings 10 are enlarged due to the elastic properties of the material of the diaphragm 9.

The embodiment according to FIG. 6 could also be modified in such a way that the hollow body 3 itself is realized in the form of an elastic diaphragm 9 with corresponding diaphragm openings 10. Analogous to FIG. 6, the restoring force for reaching the closing position of the valve element 6 also results from the inherent restoring force of the material in this case. The diaphragm openings 10 are opened in order to release liquid from the liquid chamber 4 in dependence on the magnitude of the restoring force and the counteracting centrifugal force. Due to the small diameter of the pinhole-like diaphragm openings 10, the liquid is particularly sprayed from the liquid chamber 4.

In all embodiments of the invention illustrated in the drawings, no liquid can escape from the liquid chamber 4 when the cleaning device 1 is not in contact with a surface to be cleaned, but rather merely transported, for example. In this case, the rotational speed of the cleaning roller 2 is zero such that the minimum rotational speed for respectively opening the hollow body opening 5 or the diaphragm opening 10 is not exceeded. However, when the cleaning roller 2 rotates with a rotational speed that is greater than the minimum rotational speed during a cleaning process, the liquid can be respectively released from the liquid chamber 4 through the hollow body opening 5 or the diaphragm opening 10 and used for the cleaning process.

REFERENCE LIST

1 Cleaning device
2 Cleaning roller
3 Hollow body
4 Liquid chamber
5 Hollow body opening
6 Valve element
7 Closing element
8 Return element
9 Diaphragm
10 Diaphragm opening
11 Attachment
12 Filler opening
13 Sponge body
14 Cleaning cloth
x Axis of rotation
r Moving direction

The invention claimed is:

1. A cleaning device (1), particularly a floor cleaning device, with a cleaning roller (2) that is rotatable about an axis of rotation (x) and serves for treating a surface to be cleaned, wherein the cleaning roller (2) is at least partially realized in the form of a hollow body (3) with an internal liquid chamber (4), and wherein the hollow body (3) features at least one hollow body opening (5) for releasing liquid from the liquid chamber (4), wherein a mechanically actuated valve element (6) is assigned to the hollow body opening (5), wherein said valve element can be displaced into a closing position, in which the hollow body opening (5) is closed, and/or into an opening position, in which the hollow body opening (5) is released, depending on the magnitude of a centrifugal force that acts upon the valve element (6) as a result of a rotation of the cleaning roller (2).

2. The cleaning device (1) according to claim 1, wherein the valve element (6) is designed for allowing a release of liquid from the liquid chamber (4) once the cleaning roller (2) has reached a minimum rotational speed ($n_{min}$).

3. The cleaning device (1) according to claim 1, wherein a return element (8), particularly a spring, is assigned to the valve element (6) and/or wherein the valve element (6) is realized in the form of a return element (8), wherein the restoring force of the return element (8) acts opposite to the centrifugal force in the direction of the closing position.

4. The cleaning device (1) according to claim 1, wherein the valve element (6) features at least one closing element (7) that is pivotably arranged on the hollow body (3).

5. The cleaning device (1) according to claim 1, wherein the valve element (6) features a closing element (7), which is arranged on the hollow body (3) in a linearly movable fashion, in particular slidably.

6. The cleaning device (1) according to claim 1, wherein the valve element (6) is formed by an elastic edge region of the hollow body (3), which defines the hollow body opening (5).

7. The cleaning device (1) according to claim 1, wherein the hollow body (3) is formed by an at least partially elastic diaphragm (9), wherein at least one hollow body opening (5) is contracted in the closing position and expanded in the opening position.

8. The cleaning device (1) according to claim 1, wherein an at least partially elastic diaphragm (9) containing at least one diaphragm opening (10) is arranged on the hollow body (3).

9. The cleaning device (1) according to claim 8, wherein the diaphragm opening (10) and the hollow body opening (5) are arranged on a common straight line referred to a radial direction of the cleaning roller (2).

10. The cleaning device (1) according to claim 8, wherein the diaphragm (9) is arranged on the hollow body (3) in a stationary fashion, particularly fastened on the radially outer side of the hollow body (3).

* * * * *